United States Patent [19]

Meno

[11] Patent Number: 4,677,419

[45] Date of Patent: Jun. 30, 1987

[54] ELECTRONIC MUSICAL INSTRUMENT

[75] Inventor: Frank Meno, Pittsburgh, Pa.

[73] Assignee: University of Pittsburgh, Pittsburgh, Pa.

[21] Appl. No.: 826,817

[22] Filed: Feb. 6, 1986

Related U.S. Application Data

[62] Division of Ser. No. 531,850, Oct. 17, 1983, abandoned, which is a division of Ser. No. 348,985, Feb. 16, 1982, Pat. No. 4,430,918.

[51] Int. Cl.[4] ..... H01C 13/00

[52] U.S. Cl. ..... 338/296; 84/297 S; 338/302

[58] Field of Search ..... 338/69, 296, 302, 301; 84/297 S, 199

[56] References Cited

U.S. PATENT DOCUMENTS

| | | | |
|---|---|---|---|
| Re. 26,533 | 3/1969 | Cookerly et al. | 84/1.16 |
| Re. 31,019 | 8/1982 | Evangelista | 84/1.16 |
| 3,624,584 | 11/1971 | Ohno | 338/69 |
| 3,626,350 | 12/1971 | Suzuki | 378/69 |
| 3,673,304 | 6/1972 | Dudas | 84/1.01 |
| 3,902,392 | 9/1975 | Nagahama | 84/1.01 |
| 3,948,137 | 4/1975 | Niinomi | 84/1.01 |
| 3,997,863 | 12/1976 | Luce | 338/69 |
| 4,038,897 | 8/1977 | Murray et al. | 84/1.16 |
| 4,085,647 | 4/1978 | Adachi | 84/1.24 |
| 4,135,429 | 1/1979 | Heyne | 84/199 |
| 4,176,576 | 12/1979 | Murakami | 84/1.01 |
| 4,179,971 | 12/1979 | Takahashi et al. | 84/1.24 |
| 4,235,141 | 11/1980 | Eventoff | 84/1.01 |
| 4,263,520 | 4/1981 | Kajihata et al. | 84/1.16 X |
| 4,295,402 | 10/1981 | Deutsch et al. | 84/1.03 |
| 4,306,480 | 12/1981 | Eventoff et al. | 84/1.01 |
| 4,326,444 | 4/1982 | Markley | 84/297 S |
| 4,357,852 | 11/1982 | Suenaga | 84/1.16 |

*Primary Examiner*—C. L. Albritton

*Attorney, Agent, or Firm*—Arnold B. Silverman

[57] ABSTRACT

An electronic stringed instrument which uses electrical resistance wires as strings to control the frequency of electrically generated sounds. By shorting a string at various points along its length a variable voltage output is obtained and converted into a known frequency. A fretted instrument provides a means to incrementally control the voltage output and a non-fretted type instrument with a conducting fingerboard can provide a means to variably control the voltage output. A separate current source may be provided for each string to faciliate chord playing and a control for the intensity and harmonic content of the signals is provided. An internal power supply and speaker may also be employed to make the instrument readily portable.

2 Claims, 5 Drawing Figures

ELECTRONIC MUSICAL INSTRUMENT

This is a division of application Ser. No. 531,850 filed Oct. 17, 1983, now abandoned, which in turn was a division of Ser. No. 348,985 filed Feb. 16, 1982, now U.S. Pat. No. 4,430,918.

BACKGROUND OF THE INVENTION

1. Field of the Invention

This invention relates to electronic, stringed musical instruments and more specifically, it relates to the use of resistance wires as strings which control the frequency of electronically generated sounds in such instruments.

2. Description of the Prior Art

It has been known to vary the resistance in a Wien-bridge oscillator in an electrical circuit associated with a musical instrument. See U.S. Pat. No. 3,624,584. U.S. Pat. No. 3,626,350 discloses a means to produce a portamento chord by utilizing this principle.

U.S. Pat. No. 3,948,137 discloses prior art which allows the player of an instrument utilizing a voltage controlled oscillator to control sound effects by providing wave form, filter and gain controls.

U.S. Pat. No. 4,235,141 discloses an instrument wherein an apertured insulating strip is inserted between an electrically conducting strip and a resistive strip to only allow contact points at predetermined locations, thereby producing a tone at discrete selected values of frequency.

Electrically synthesized music is an increasingly popular art form in which substantial technological advances have been made. In the past, however, most of these advances could only be utilized in a keyboard type instrument excluding musicians skilled primarily in the playing of stringed instruments.

A known attempt to provide a voltage controlled electronic stringed instrument is U.S. Pat. No. 4,038,897. In this patent, a guitar or other fretted instrument is used to produce input signals for a voltage-controlled tone generator or the guitar can be used in the conventional fashion by operating a switch. Each string-fret pair has an assigned musical tone. Voltages analogous to said tones are applied to the instruments frets so as to apply such voltage to the strings when the strings contact the frets.

Such systems have several major limitations. Firstly, the invention is limited to fretted stringed instruments. Additionally, complicated wiring of resistors to each fret is required in order to provide each with the proper voltage value. Finally, providing the voltage to electrically conducting frets appears to foreclose the possibility of playing chords without fret segmentation.

There remains, therefore, a need for a stringed electronic instrument which provides effective frequency control in either fretted or unfretted string instruments employing the strings as resistance and a means for playing chords whether or not frets are desired.

SUMMARY OF THE INVENTION

The present invention has produced a solution to the above need by providing an instrument which uses electrical resistance wires as strings to control the frequency of electrically generated sounds. The frequencies are produced by voltage to frequency converters or other suitable circuits. More specifically, the variable voltage output that controls frequency is obtained by shorting at various points along its length a constant electrical current supplied to a string. This shorting operation can be employed in two distinct classes of stringed instruments. In a guitar or other fretted instruments the resistance strings can be shorted at any single fret providing a means to incrementally control the voltage output of the instrument. In a violin or other non-fretted instruments the surface of the fingerboard facing the strings can be made of an electrical conducting material so the resistance strings can be shorted at any point providing a means to variably control voltage output.

Each string is provided with a separate current source but all strings are referenced to the same grounding point. The frets or the entire conducting surface of the neck in the case of a violin type instrument are also grounded. The non-grounded end of each string is connected to a current source. The voltage drop is detected so that the strings do not interfere with each other at the frets and consequently, chords can be played.

In the past, most voltage controlled electronic instruments employed Wien-bridge oscillators or similar circuits which required relatively high resistance values for the control element. The present invention, however, utilizes a voltage to frequency converter circuit which can be controlled by relatively low resistance values as the voltage can be simplified before conversion, making possible the use of low resistance wires as the control elements. Furthermore, the high stability of the resistance, the constant current sources, and the precision of commercial voltage to frequency converters will make this type of instrument of professional quality.

The embodiments of the present invention provide a means for controlling the intensity and harmonic content of the signals produced. More specifically, suitable attenuators and filters are controlled by one of the player's hands while the other presses the strings to produce the desired frequency. Wound resistance wire strings may be provided for low notes as well as a method for producing the same.

In one embodiment of the present invention an internal power supply and speaker are provided to make the instrument readily portable.

In another embodiment of the present invention a frequency counter is integrated into the instrument's electrical circuit to facilitate tuning.

It is further contemplated that combining the electrical and mechanical string produced sounds may have potential for expanding the instruments artistic possibilities.

It is an object of the present invention to provide a voltage controlled stringed musical instrument which utilizes resistance wires as strings.

It is yet another object to employ resistance wire strings in both fretted and non-fretted instruments.

It is a further object of the present invention to utilize a constant current generator in embodiments in which a linear relationship between the length of the string and the frequency is desired.

It is yet another object of this invention to provide a means to produce suitable strings for the instrument.

It is yet another object of this invention to provide a means for controlling the intensity and harmonic content of the sounds produced.

It is yet another object of this invention to provide a self-contained package including a speaker and internal power source so as to make said instrument readily portable.

These and other objects of the invention will be fully understood from the following description of the invention on reference to the illustrations appended hereto.

DESCRIPTION OF THE PREFERRED EMBODIMENTS

As used herein, in the absence of a clear, express indication to the contrary at a specific location, the terms "string" and "strings" refer to either straight or wound electrically conductive resistance wires.

As used herein, in the absence of a clear, express indication to the contrary at a particular location the terms "conducting" and "insulating" refer respectively to a materials capacity to conduct or to resist the conduction of an electrical current.

The present invention provides a musical instrument which varies the input voltage in an electrical circuit and converts the voltage to a frequency to produce a responsive musical tone. The voltage (V) in the circuit is dependant upon two variables, current (I) and resistance (R) according to $V=IR$. It is preferred, but not required, to provide the instrument with a constant current source of power which results in a linear relationship between the voltage and resistance. The instrument's strings provide the resistance element in the circuit. By urging a string against a conducting surface at different points along the string's length the circuit's resistance and the resulting voltage drop can be effectively controlled and varied.

Figure 1:
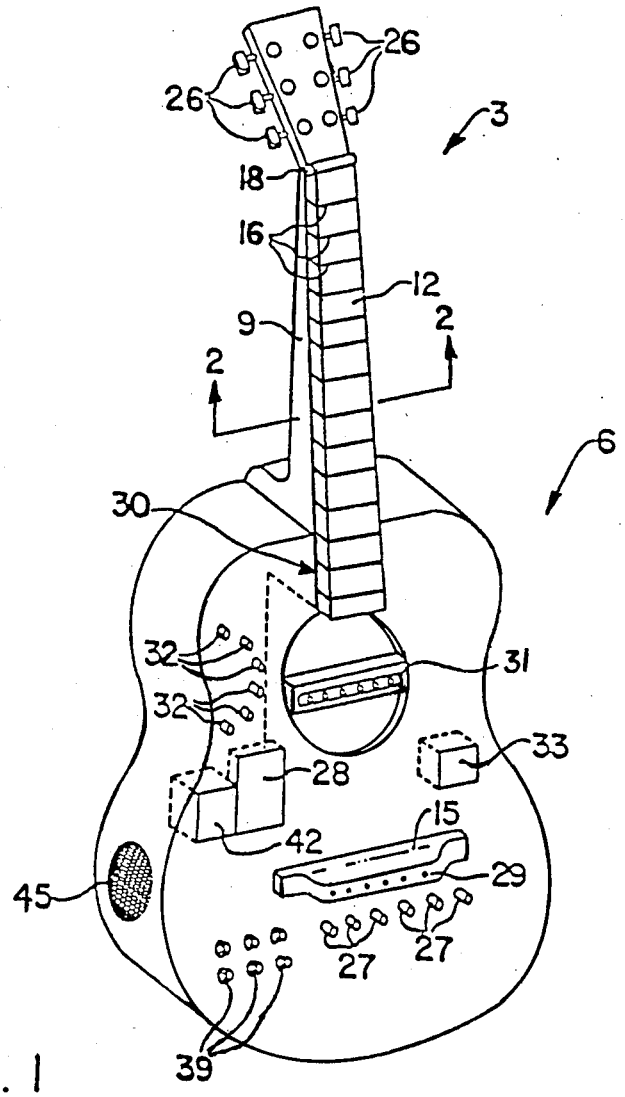
FIG. 1 is a schematic view of one form of the invention showing an electrically insulating fingerboard and conducting frets.
Figure 2:
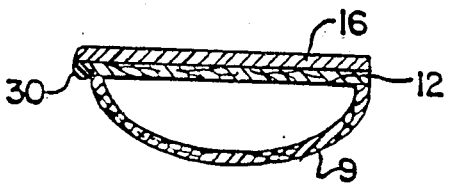
FIG. 2 is a cross-sectional view of the fingerboard shown in FIG. 1 taken through 2—2 of FIG. 1.

Referring more specifically to FIGS. 1 and 2 (wherein for clarity of illustration the strings have not been shown), one embodiment of the present invention, a guitar type fretted instrument is shown. The instrument 3 has a body 6 having any convenient shape and preferably is made of a rigid electrically insulating material. One end of neck 9 is secured to the body as by conventional means. The neck 9 is also preferably an insulator but both the neck and body may be conductors if desired. A rigid insulating fingerboard 12 is attached to neck 9. A hardwood or rigid plastic would be a suitable material to construct the fingerboard 12. An insulating bridge 15 is also secured to the body 6, so as to provide a means to elevate the strings a slight distance above the fingerboard 12.

A plurality of conducting frets 16 are embedded across the fingerboard 12 at desired points along its length. The fret spacing may remain essentially the same as in regular guitars, and the current can be adjusted to correspond to the same notes. The frets 16 are preferably made from a hard conducting metal such as stainless steel. Embedded at the end of the fingerboard 12 farthest away from the body 6 is a rigid conducting shorting bar 18 to support the strings (not shown) a slight distance above the uppermost fret 16.

Each of the frets 16 are electrically connected together in series and connected to the electrically grounded shorting bar 18 by a conductive connecting wire 30, as shown in FIGS. 1 and 2. The frets 16 may be connected together and to the shorting bar by any other suitable means such as a conducting strip mounted under the insulating fingerboard 12 which contacts each of said frets 16.

The strings (not shown) are attached to the instrument by conventional means and, as mentioned, are supported above the frets on one end by the insulating bridge 15 and at the other end by the shorting bar 18. The strings are tuned mechanically by adjusting their tension by turning tuning keys 26 in the usual fashion. Electronic tuning of each string is accomplished by turning a potentiometer knob 27 suitably wired into the circuit by means well known in the art. A frequency counter 33 may also be integrated into the circuit to facilitate tuning. A constant current power source and amplifier circuit 28 (see FIG. 3) is connected to each string at or near the bridge 15 by any suitable means. It is preferable to make these connections at points 29 to avoid interference with the strings mechanical vibration. Points 29 may also serve as the input to an amplifier. It is contemplated that an internal power supply 42 and speaker 45 could also be provided to make the instrument more portable. It is preferable to keep the resistance values of the strings below 1000 ohms so that the changes in finger contact reistance do not play a perceptive role, unless such an effect were desired. Contacting a string to a chosen fret will complete an electrical circuit and create a desired voltage output which is then converted into a frequency signal by means well known in the art. Such voltage to frequency converters are now available as commercial intergrated circuits.

It will be appreciated by those skilled the art that by eliminating the frets and replacing or covering the insulating fingerboard with a sheetlike conducting fingerboard, a violin type non-fretted instrument will function essentially as described above. With this embodiment continuous variability of pitch can be achieved.

The present invention also provides a means for controlling the harmonic content and intensity of the signals produced. First, the pitch or fundamental frequency is selected by means of a particular string. Harmonic frequencies are then selected by color control registers 39.

It is contemplated that the loudness can be effectively controlled in one of two ways. In one embodiment, the strings would be plucked or banged as in conventional instruments. Below each string would be placed an electromagnetic pickup 31 as is done in conventional electric guitars. The output of this pickup would then be amplified and rectified to derive the intensity envelope of the vibration, which is proportional to loudness. This loudness envelope voltage would then be used to control the loudness of the electronic sound by means of voltage controlled amplifiers.

In another embodiment of the present invention, it is contemplated that suitable pressure transducers 32, which can respond properly and rapidly to finger pressure, could be manipulated by the players free hand to control loudness. The above mentioned pressure transducers could be in the form of buttons, perhaps one to control each string or any combination of strings. The voltage from these transducers would be applied through a voltage controlled amplifier to effectively control loudness. The separate control of the duration and loudness of each note in a chord is made possible by the use of this method, thereby, allowing for greater flexbility and creative potential.

Figure 3:
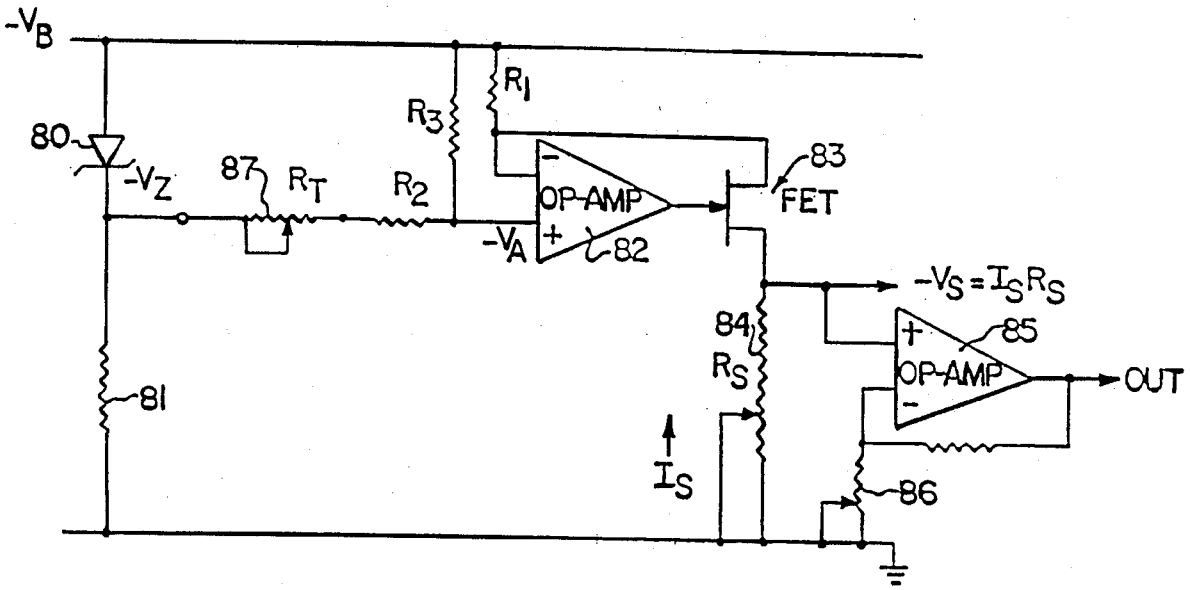
FIG. 3 is a schematic circuit diagram of a circuit to provide a suitable constant current source for the instrument.

FIG. 3 shows a schematic circuit diagram of a typical circuit to provide a suitable constant current source for this instrument and the first stage of amplification. The constant reference voltage $-Vz$ is obtained by means of the Zener diode 80 and the resistor 81. The resistor network $R_3$, $R_2$ and $R_T$ apply a fraction of this voltage to the non-inverting input of the operational amplifier 82. The inverting input is connected to the resistor $R_1$ in which the voltage drop is proportional to the current $I_S$ which flows through the controlling field-effect transistor 83 and the string 84 with with the effective resistance $R_S$. The voltage drop over $R_S$ is $I_S R_S$. This is fed to the amplifier 85 with the provision to adjust the gain by means of the control 86. The value of the constant current $I_S$ can be adjusted by means of the tuning control 87 through the relationship $I_S = V_Z R_3 / R_1 (R_2 + R_3 + R_T)$.

Figure 4:
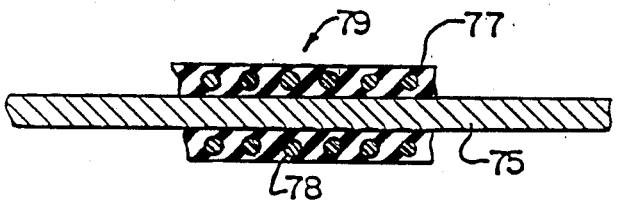
FIG. 4 is a cross-sectional view of a wound resistance wire string.

FIG. 4 represents a cross-sectional view of a string wound with resistance wires for low notes. A steel wire 75 of suitable diameter is used for the core. A well insulated resistance wire 77 is then tightly wound onto wire 75. The whole string 79 might then be dipped into a suitable resin (such as epoxy) to tightly fixate the insulation 78 in order to prevent electrical contact towards the core and between the turns on account of abrasion due to internal flexing. The insulation 78 would then be removed as by sanding only on the string's outer surface so that the string can make contact with the frets.

Figure 5:
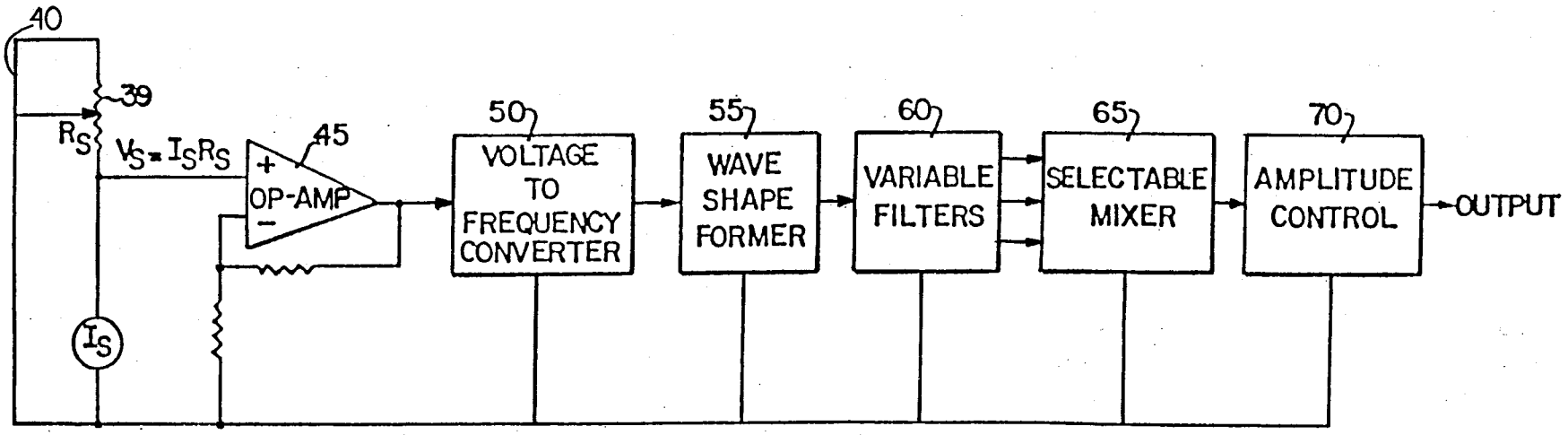
FIG. 5 is a block diagram of the various steps involved in converting changes in the string resistance into frequency signals of desired quality characteristics.

FIG. 5 is a block diagram of one embodiment of the present invention showing the various steps in converting voltage signals into frequency signals of desired wave characteristics. As string 39 is pressed to contact fret 40 an electrical circuit is completed. The resistance of the portion of the string now included in the circuit will alter the voltage in the circuit according to $V = IR$. By pressing the string to contact other frets (not shown) different voltage ouputs can be obtained. The voltage signal is then amplified by the operational amplifier curcuit 45 as shown. As indicated in block 50 of FIG. 5, the amplified voltage signal obtained by the above described method is then converted into a frequency signal. Depending on the type of voltage to frequency converter employed the output frequency signal may be a sine wave or some other wave form. This output frequency signal may then by inputted into a wave shape former shown in block 55. After a desired wave form is obtained, the basic frequency signal may then be filtered to remove undesired "harmonics" in the circuit as is indicated by block 60. Block 65 shows a selectable mixer which can be used to combine the frequency signals to produce various coloration of the sound. The output of the mixer is then attenuated as desired by a suitable circuit to control loudness, as shown by block 70.

While I have shown and described certain present preferred embodiments of the invention and have illustrated a present preferred method of practicing the same it is to be distinctly understood that the invention is not limited thereto but may be otherwise variously embodied with the scope of the following claims.

I claim:

1. A wound string for a voltage controlled stringed instrument which utilizes resistance wires as strings to control the frequency of electronically generated sounds comprising:

an electrically conducting core, resistnce wire insulated and generally tightly wound about an attached to said core, and said insulation removed from the outer surface of said wound string.

2. A wound string according to claim 1 wherein said core is a steel wire.

* * * * *

UNITED STATES PATENT AND TRADEMARK OFFICE

CERTIFICATE OF CORRECTION

PATENT NO. : 4,677,419

DATED : June 30, 1987

INVENTOR(S) : FRANK MENO

It is certified that error appears in the above-identified patent and that said Letters Patent is hereby corrected as shown below:

In the Abstract, line 11, "faciliate" should be --facilitate--.

Column 2, line 26, "simplified" should be --amplified--.

Column 4, line 39, "skilled the" should read --skilled in the--.

Column 5, line 6, "flexbility" should be --flexibility--.

Column 5, line 17, "with" , second occurrence, should be deleted.

Column 6, line 6, "curcuit" should be --circuit--.

Claim 1, column 6, line 34 "resistnce" should be --resistance--.

Signed and Sealed this

Twenty-ninth Day of March, 1988

*Attest:*

DONALD J. QUIGG

*Attesting Officer*

*Commissioner of Patents and Trademarks*